US006664519B2

(12) United States Patent
Hammelsbacher et al.

(10) Patent No.: US 6,664,519 B2
(45) Date of Patent: Dec. 16, 2003

(54) TOUCH-SENSITIVE OPERATING PANEL FOR COOKING ZONES

(75) Inventors: Karlheinz Hammelsbacher, Schwabach (DE); Alfred Kotouczek, Schwaig (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 141 days.

(21) Appl. No.: 10/061,495

(22) Filed: Feb. 1, 2002

(65) Prior Publication Data

US 2002/0113061 A1 Aug. 22, 2002

(30) Foreign Application Priority Data

Feb. 16, 2001 (DE) ..... 101 07 206

(51) Int. Cl.[7] ..... H05B 1/02; H05B 3/68

(52) U.S. Cl. ..... 219/506; 219/508; 219/487; 219/445.1; 219/457.1

(58) Field of Search ..... 219/506, 508, 219/487, 486, 480, 445.1, 457.1

(56) References Cited

U.S. PATENT DOCUMENTS

| | | | | | |
|---|---|---|---|---|---|
| 3,974,472 | A | * | 8/1976 | Gould, Jr. | 345/211 |
| 4,493,979 | A | * | 1/1985 | Bredel et al. | 219/446 |
| 5,097,113 | A | * | 3/1992 | Aoyama | 219/506 |
| 6,198,080 | B1 | * | 3/2001 | Rice et al. | 219/506 |
| 6,376,809 | B1 | * | 4/2002 | Huber et al. | 219/445.1 |
| 6,501,053 | B2 | * | 12/2002 | Becker et al. | 219/506 |

FOREIGN PATENT DOCUMENTS

| | | | |
|---|---|---|---|
| DE | G 940 90872.2 | | 3/1995 |
| DE | 19645907 | * | 5/1998 |
| DE | 198 02 571 | | 8/1999 |
| DE | 19817195 | * | 9/1999 |
| DE | 199 25 228 | | 12/2000 |
| EP | 868109 | * | 9/1998 |
| EP | 990 855 | | 4/2000 |

* cited by examiner

*Primary Examiner*—John A. Jeffery
(74) *Attorney, Agent, or Firm*—Scully, Scott, Murphy & Presser

(57) ABSTRACT

In order to be able to dispose the whole of the electrical circuitry of the operating panel (14) of a cooker top (11) on a single, single-layer circuit board (even if lined on both sides) of dimensions which do not project beyond the operating panel (14), there is provided a button selector switch (18) with which a cooking stage switch (19; 19–, 19+) which is also button-actuable can be cyclically successively switched to each of the cooking zones (12) provided, while the other cooking zones (12) remain in their current switching condition. Which of the cooking zones (12) is in operation at the present time and which of them is currently selected by way of the selector switch (18) can be seen from the optical signalling of miniaturized cooking zone lamps (22) or digital displays (23) which are arranged in a manner corresponding to the geometry of the cooking zones (12). A digital display indicates the currently predetermined cooking stage (23) for the currently selected cooking zone (12). In order to avoid separate residual heat lamps (29), the respective cooking zone lamp (22) or display (23) does not yet go out when its cooking zone (12) is switched off, but goes out only when the associated cooking zone (12) is cooled down below the residual temperature which is critical in terms of touching it.

5 Claims, 1 Drawing Sheet

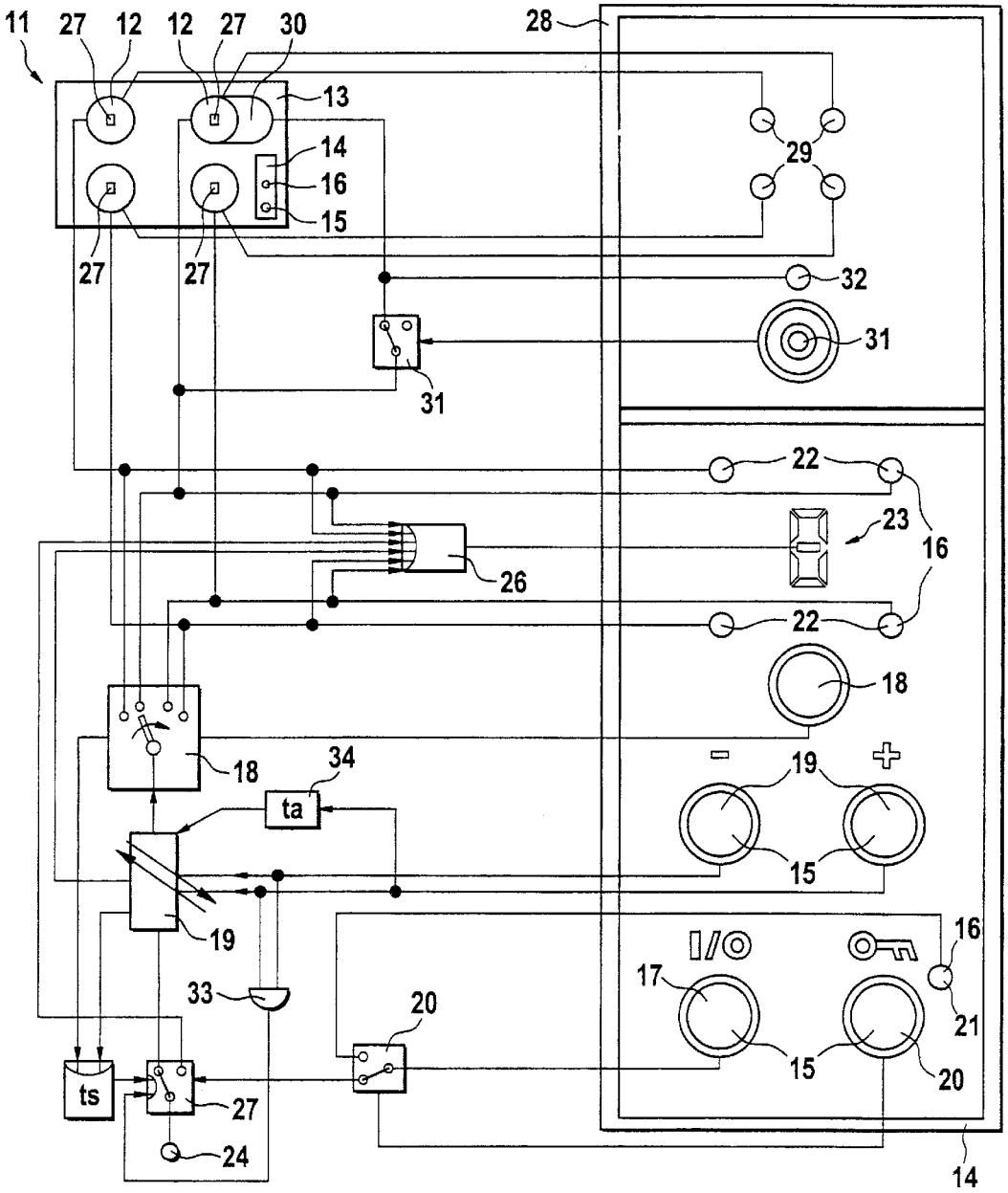
11
27
12
12
27
30
28
13
14
16
15
29
27
27
32
31
31
22
23
16
26
22
18
18
34
ta
19
15
19
16
17
21
33
20
15
20
ts
27
24
14

TOUCH-SENSITIVE OPERATING PANEL FOR COOKING ZONES

BACKGROUND OF THE INVENTION

1. Field of the Invention

The invention concerns an operating panel in the form of a touch switch, including a digital cooking stage display for a cooker top having a plurality of cooking zones, as is on the market in the form of the system referred to as "DIEHL TC 2" or in the form of the system referred to as "EGO Touch Control G II".

2. Discussion of the Prior Art

Such operating panels essentially comprise an opening-free and opaquely coloured insulating plate which is arranged in front of the cooking zones in the cooker panel or beside the cooking zones in the region of the pan support and working surface of a cooker, wherein arranged below the insulating plate are contact-less switches in the form of proximity or capacitor sensors and opto-electronic display lamps in the form of punctiform or seven-segment light emitting diodes. When integrated into the cooker hob a region of the glass ceramic hob thereof also serves as the operating panel. To provide for a meaningful association between the switching and display locations of such a complexly integrated operating panel on the one hand and the cooking zones in the cooker hob on the other hand, a switching location with a display location closely adjacent thereto is geometrically associated with each cooking zone, in the operating panel. For the situation which usually occurs, involving a cooker hob with four cooking zones, it is usual to arrange four switching locations at the corners of a square and, directly beside them, to provide four display locations in the form of simple light points or in the form of single-digit seven-segment alternate figure representations. As a circuit board extending under the glass plate member of the operating panel parallel thereto, besides the above-mentioned elements, must also include further switching and display elements, in particular for change-over switching operations and for indicating residual heat and possibly also for time control functions, and as weak-current circuits for the control and display procedures and relay-switched heavy-current circuits for the power consumers, wherein such circuits are interwoven with each other from the point of view of the circuitry involved, have to be disentangled in order to maintain given insulation spacings for safety reasons, it is impossible in the previous art to dispose all the above-mentioned circuit components and the circuit wiring thereof on a circuit board corresponding to the dimensions of the operating panel, not even when the conductor tracks are disposed on both sides. Therefore, operating panels of that kind generally involve a sandwich structure comprising two circuit boards which extend in mutually spaced parallel relationship, which involves a corresponding alternate connecting complication and expenditure and a need for appropriate installation depth, which gives rise to high production and testing costs.

SUMMARY OF THE INVENTION

In consideration of those factors the object of the present invention is to simplify the operating panel, in particular for a four-zone cooker hob which is usually to be encountered, in such a way as to permit a noticeable reduction in the circuitry complication and expenditure in terms of switching and display control and the arrangement thereof on a single board.

In accordance with the essential combination of features set out in the main claim, in accordance with the invention that object is attained in that only one single cooking stage switching location for a plurality of usually four cooking zones is provided in the operating panel. In that way it is surprisingly possible to save on half the expensive circuit board area because, by virtue of simplified control circuits and correspondingly simplified conductor track intermingly, the circuitry structure is now made possible in one circuit board plane, which, with comparable functionality, in comparison with the above-described sandwich structure in accordance with the state of the art, results in a saving of approximately 20% each on manufacturing and testing costs. That is highly remarkable having regard to the enormous price pressure applied to the development of large-scale domestic appliances, of which on the other hand consumers expect ever more extensive functionality.

BRIEF DESCRIPTION OF THE ACCOMPANYING DRAWINGS

In regard to additional aspects of the invention and in relation to developments thereof and advantages thereof, besides the appendant claims, attention is also directed to the description hereinafter of a preferred embodiment of the structure according to the invention which is shown in highly diagrammatic and abstracted form in the drawing, being limited to what is essential. The single FIGURE of the drawing shows an operating panel designed in accordance with the invention with its switching and display locations and the functional operative interrelationships thereof in the manner of a greatly simplified block circuit diagram in which however, to keep the drawing simple, it is not specifically indicated that each cooking zone is provided with its own power switching circuit in the form of a pulse width modulator, wherein those modulators are called up in succession to set the cooking stages and the respective current cooking stage setting of a cooking zone is maintained when (with the visual impression of the cooking zone lamp thereof being switched over), further switching to the next following cooking zone is implemented at the cooking stage switch.

DETAILED DESCRIPTION OF A PREFERRED EMBODIMENT

Reference 14 denotes an operating panel which is disposed beside an electric cooker top 11 with in the illustrated example four cooking zones 12 which for example are equipped with radiant heating assemblies, or integrated in the cooker hob 13 thereof, and which in terms of the arrangement of its switching locations 15 and display locations 16 is shown in detail once again on an enlarged scale at the right of the drawing. The surface of the operating panel 14 is not apertured for operation of the switching and display locations 15, 16, the sensors and lamps of which are therefore recessed under the top surface of the operating panel, which is at the operating and viewing side thereof, and possibly recessed at the rear in the transparent panel member thereof, or the sensors and lamps are simply pressed thereagainst. The switching locations 15 in the operating panel 14 are therefore the reactive regions of proximity or touch switches for example based on reflection light barrier assemblies with invisible radiation or on the basis of capacitive sensors. The switching locations 15 act as pulse inputs on bi-stable switches which are usually embodied in a processor which also deals with superior control tasks for example in accordance with a predetermined program procedure, which however is not shown in detail in the drawing in terms of the circuitry involved, in order to make the drawing simpler to view. At switching locations 15 the operating panel 14 includes in particular a mains switch 17, a cooking zone selector switch 18 and a cooking stage switch 19 which is subdivided into two opposite functionalities 19– and 19+ for increasing or reducing the heat output. A safety switch 20 with an electro-optical blocking indicator 21, like the other display lamps in the form of an incandescent lamp or a light-emitting diode, is also desirable. The selector switch 18 is linked to such display locations 16 which preferably involve cooking zone lamps 22 geometrically associated with the cooking zones 12, and at least as diagrammatically illustrated by way of example one single digital cooking stage display 23 in the form of a seven-segment digit representation which is then arranged in the centre between the lamps 22.

The components of the switching locations 15 and the display locations 16 are arranged on a single board which is lined on both sides and which (not visible in the drawing) extends at a spacing relative to the operating panel 14 and below same and does not project beyond the periphery thereof, or at any event not substantially. That board is prepared for fitting with the cooking stage display 23 in such a way that the single-digit alphanumeric seven-segment display can also be positioned pivoted through 90° with respect to the illustration in the drawing, whereby, instead of the illustrated vertical arrangement, the operating panel 14 can also entail horizontal orientation in or beside the cooker top 11.

The cooker top 11 is connected to the mains 24 by single actuation of the mains switch 17. For the sake of safety it can be provided that the mains switch 17 switches off again directly after a fixedly predetermined safety period ts of some seconds—unless, within that safety period ts, another of the switching locations 15 is also activated, for example a cooking zone 12 is selected by way of the switch 18 OR the cooking stage of the cooking zone 12 which has just been selected is altered by way of the switch 19. If however a safety switch 20 is set, that is to say the blocking indicator 21 thereof lights up, the cooker top 11 cannot be switched on.

Disposed beneath the display locations 16 are four zone lamps 22 which are geometrically associated with the cooking zones 12, preferably also in the form of light emitting diodes like the other optical indicators, the lighting-up thereof indicating which of the cooking zones 12 are being heated at the present time. The individual heating output can be influenced by means of the cooking stage switch 19 in the manner of a mains frequency-synchronised or processor-synchronised pulse width modulation procedure, and visualised by means of the seven-segment cooking stage display 23 which in this embodiment is the only one provided. The processor sub-function for converting the current degree of modulation into a digit representation is symbolically indicated in the block circuit diagram of the drawing by a demodulator 26 which converts the pulse length in relation to the cycle duration into a number between 0 (switched off) and 9 (maximum power). This number (23) therefore indicates with which cooking stage that cooking zone 12 whose lamp 22 is just flashing is actually being operated. A modified presetting for that heating power is effected by alternative repeated or continuous actuation of one of the cooking stage function switches 19– or 19+. The lamp 22 associated with the cooking zone 12 which is still selected at the present time then switches over from flashing light to continuous light, while however that cooking zone 12, as mentioned, retains the cooking stage which was last predetermined, if by means of the selector switch 18 the arrangement is switched over to the next one of the cooking zones 12 which are to be cyclically selected, so that now the zone lamp 22 thereof no longer lights constantly but only at an interval and the display 23 indicates the present cooking stage. It will be noted that the four separate lamps 22 are unnecessary if they are replaced by four displays 23 (instead of the one central display in the drawing).

The cooking zone 12 which has just been selected and which is therefore marked by the currently flashing lamp 22 or display 23 is however electrically switched off and its lamp 22 or its display 23 is entirely switched off if the heating output is here reduced to zero by means of the cooking stage switch 19–. If however the cooking stage switches 19–, 19+ are actuated not alternately but simultaneously, as diagrammatically indicated by the AND-gate 33, that one of the cooking zones 12 which is just being indicated is directly electrically switched off and its zone lamp 22 or display 23 goes out. In contrast, the cooker top 11 generally, that is to say all of its cooking zones 12 which have just been switched on, is switched off by way of the mains switch 17.

The cooking zone 12 which has just been selected by way of the selector switch 18 for setting the cooking stage thereof is therefore identified by a cooking zone lamp 22 or display 23, which is not continuously lit but flashes. Switching over to the next cooking zone 12 with the cooking zone lamp 22 or display 23 thereof is effected in a cyclic sequence progressively with each repeated brief actuation of the selector switch 18. With only one central display 23, the cooking stage display 23 which is numerically represented at a given time relates to that cooking zone 12 whose lamp 22 is not extinguished or is continuously lit but is just flashing.

As is known, not only numerical but also given alphabetical information can be displayed in a single FIGURE fashion by way of such a seven-segment display 23. Thus, the display 23 is switched over by the demodulator 26 to the display H if the cooking zone 12 which has just been selected by way of the switch 18 was admittedly electrically switched off (by way of the cooking stage switch 19– or by way of both switches 19–/19+ at the same time), but the geometrically associated cooking zone lamp 22 or display 23 has not yet gone out, but initially still remains actuated, because the associated cooking zone 12 is still hot, more specifically the temperature thereof has not yet fallen below the order of magnitude of 50° C. and it is therefore still irradiating a residual heat which is at risk of causing a burn to the surface of the human skin. That is detected by means of temperature sensors 27 whose sensor signals are suitably analysed by the processor, namely compared to a reference and possibly applied to the actuating circuits (not identified separately in the drawing) for the cooking zone lamps 22 or displays 23; or a pre-set time-control circuit which is embodied in the processor by means of counters causes that residual heat display to be extinguished if on the basis of experience the cooking zone 12 should have cooled down sufficiently after it was switched off.

In an extension 28 of the basic operating panel 14 residual heat lamps 29 functionally separate from the functions (continuous light or flashing light) of the cooking zone lamps 22 can be provided in geometrical association with the cooking zones 12 in order to render redundant the above-mentioned H-display 23 in the centre of the cooking zone lamps 22 or a respective display 23 for each of the four cooking zones 12. If, at the respective cooking zone 12, the temperature exceeds the surface temperature which is critical in terms of the risk of scorching the human skin, the associated residual heat lamp 29 in the operating panel extension 28 lights up; in that case, it can be provided in terms of circuitry by way of the processor that this light indication switches over for example between continuous light and flashing light, depending on whether the associated cooking zone 12 is being actively heated at the present time or is switched off and is only still holding residual heat.

The highest stage of the upward cooking stage function switch 19+ does not read "9" but above it "A". If the display 23 is set at "A" at the cooking stage switch 19 before the selection of a given stage, then cooking is effected by way of the cooking zone 12 which has just been selected, initially at its maximum, corresponding to the stage 9. After the period of time ta a timing circuit 34 then switches back to the cooking stage which, after initialisation by way of "A", is thereafter predetermined at a lower value and which, with selection of that cooking zone 12, is in fact already displayed by the alphanumeric display 23 in the form of a digit alternating with the letter "A", during the period ta, that is to say, until it switches over to a continuous display.

Often at least one of the cooking zones 12 is provided with a surface extension which can be annular for relatively large cooking pans or which, as in the illustrated embodiment, can be arcuate in the form of a frying zone 30 which can be switched on separately. Provided for operation thereof is a fryer mains switch 31 in the operating panel extension 28, together with a fryer display lamp 32. The cooking stage setting for the fryer zone 30 is implemented at the switch 19 with the cooking stage setting for the adjacently associated cooking zone 12, which is symbolically represented in the block circuit diagram in the drawing.

In order to be able to dispose the whole of the electrical circuitry of the operating panel 14 of a cooker top 11 therefore inexpensively on a single, single-layer circuit board, even if lined on both sides, of dimensions which do not project beyond the operating panel 14, the invention provides a button selector switch 18 with which a cooking stage switch 19; 19–, 19+ which is also button-actuable can be cyclically successively switched to each of the cooking zones 12 provided, while the other cooking zones 12 remain in their current switching condition in terms of their heating outputs. Which of the cooking zones 12 is heated at the present time and which of those is the cooking zone which is currently selected by the selector switch 18 can be seen from the optical signalling afforded by miniaturised cooking zone lamps 22 or digital displays 23 which are arranged in a fashion corresponding to the geometry of the cooking zones 12. Just a single alphanumeric digital display 23 is sufficient to indicate the currently predetermined cooking stage 23 for the currently selected cooking zone 12 in numerical mode and to indicate any special operating condition such as initial cooking mode "A" or still Hot cooking zone "H" in alphabetical mode. In order to avoid the use of separate residual heat lamps 29 the respective cooking zone lamp 22 or display 23 does not yet go out when the cooking zone 12 thereof is switched off, but goes out only when the associated cooking zone 12 has cooled down below the residual temperature which is critical in terms of touching the cooking zone.

What is claimed is:

1. A touch switch operating panel (14) for the starting of cooking stages including a digital cooking stage display (23) on a cooking top (11) having plurality of cooking zones (12), each of said cooking zones having an optical display associated therewith, which are individually selectable for the starting of cooking stages and settable through plus +/minus – function switch elements (19+, 19–) of a cooking stage switch (19); wherein for a circuit arrangement on a single plate surface with lamps (22), displays (23) and sensor switch locations (15; 17, 18, 19) located below an uninterrupted said operating panel (14) there is provided a single selector switch (18) for all cooking zones (12) for a cyclical actuation of the cooking stage switch (19) designed as pulse width modulators for the individual cooking zones (12), said operating panel (14) in the presence of cooking zone lamps (22) having in the center of the arrangement of said lamps a cooking stage display (23) selectively common to all of said lamps or individually to each of said lamps which remain actuated as long as the therewith associated cooking stages are not actually set to zero, which is implemented for the individual presently selected cooking zone (12) through a simultaneous actuation of both cooking stage function switch elements (19+, 19–) or for the entire cooking top (11) through actuation of a mains switch (17) located in the operating panel (14).

2. An operating panel according to claim 1, wherein each said cooking zone lamp (22) remains actuated through either a temperature sensor (27) or a timer after the cooking stage switch (19) is set to zero (0) until the temperature at the therewith associated cooking zone (12) has fallen below a temperature selected as being safe to touch.

3. An operating panel according to claim 1, wherein an operating panel extension (28) of said panel (14) includes residual heat lamps (29) which are operatively associated with respective cooking zones (12) and which remain actuated for as long as the temperature of the therewith associated cooking zone (12) is above a temperature which is critical to safely touching thereof.

4. An operating panel according to any one of the preceding claims, wherein the cooking stage switch (19) is subdivided into two said function switch elements (19–, 19+) for selectively reducing or raising the heating output of a currently selected cooking zone (12) and which maintains the operating condition of the cooking stage of said zone when the cooking stage switch (19) is subsequently operatively associated with another cooking zone (12) through actuation of the selector switch (18).

5. An operating panel according to claim 1 or 2, wherein an extension (28) of said operating panel (14) includes a mains switch (31) with an indicator lamp (32) through which a laterally adjacently adjoining heated zone (30) can be added to a cooking zone (12).

* * * * *